US007972024B2

(12) United States Patent
DeLeeuw

(10) Patent No.: US 7,972,024 B2
(45) Date of Patent: Jul. 5, 2011

(54) ILLUMINATING DEVICE

(76) Inventor: Bronson DeLeeuw, Greeley, PA (US)

( * ) Notice: Subject to any disclaimer, the term of this patent is extended or adjusted under 35 U.S.C. 154(b) by 445 days.

(21) Appl. No.: 11/937,622

(22) Filed: Nov. 9, 2007

(65) Prior Publication Data

US 2009/0122525 A1 May 14, 2009

(51) Int. Cl.
*F21V 21/08* (2006.01)

(52) U.S. Cl. ..... 362/103; 362/253; 362/572; 362/573; 433/29; 433/30; 433/31

(58) Field of Classification Search ..... 362/103, 362/253, 572, 573; 433/29–31
See application file for complete search history.

(56) References Cited

U.S. PATENT DOCUMENTS 4,063,552 A * 12/1977 Going et al. ..... 128/861
5,226,712 A * 7/1993 Lucas ..... 362/103
5,473,520 A * 12/1995 Malley ..... 362/190
6,299,441 B1 * 10/2001 Novak ..... 433/29
6,769,788 B1 * 8/2004 Kellough ..... 362/208
2004/0043349 A1 * 3/2004 Liao ..... 433/29
2005/0016550 A1 * 1/2005 Katase ..... 131/194
2005/0284489 A1 * 12/2005 Ambis ..... 128/859
2007/0151568 A1 * 7/2007 Maurello ..... 128/859
2007/0259310 A1 * 11/2007 Goodson et al. ..... 433/29

* cited by examiner

*Primary Examiner* — Sandra L. O Shea
*Assistant Examiner* — Mary Zettl
(74) *Attorney, Agent, or Firm* — Michael Ries

(57) ABSTRACT

Disclosed is an illuminating device that includes a light source and a mouthpiece. The mouthpiece is configured to adapt the light source thereon and is capable of being accommodated within a user's mouth. The mouthpiece includes a switch and a power source. The switch is electrically connected to the light source. The power source is electrically connected to the switch and the light source and is capable of providing electrical power to the light source for illumination. Upon receipt of the mouthpiece within the user's mouth and application of pressure on the switch by the user's teeth, the light source is illuminated.

8 Claims, 3 Drawing Sheets

ILLUMINATING DEVICE

FIELD OF THE INVENTION

The present invention generally relates to an illuminating device, and, more particularly, to a hands-free operable illuminating device.

BACKGROUND OF THE INVENTION

More often than not, physical tasks require use of both hands of a worker. For example, mechanics, contractors, plumbers, locksmiths, woodworkers, and similar workers, need to use both their hands while performing their job-related activities. When performing these job-related activities in insufficient ambient light or in the dark, a worker may require additional light source, such as a flashlight, torchlight, and the like. Generally, the worker would need to compromise on the job by making use of one hand to hold the light source and perform the job with other hand. Occasionally, the worker may hold the light source in his mouth and use both hands to work on the job. However, holding the light source in the mouth may cause excessive salivation, leading to uneasiness or discomfort to the worker. Moreover, it may lead to obstruction in conversing with fellow co-workers. Further, when the worker needs to operate the light source, he may have to use his hands to switch on the light source before placing the light source in his mouth. Other than that, the light source may be too bulky to be appropriately held by the worker's mouth. Moreover, the light source may have sharp corners or edges that may hurt the worker in his mouth.

Accordingly, there is need for a hands-free operable illuminating device for providing additional light to users, in an easy and reliable manner.

SUMMARY OF THE INVENTION

An object of the present invention is to provide an illuminating device capable of being operated as a hands-free illuminating device by a user.

Another object of the present invention is to provide an illuminating device capable of being operated by placement in a user's mouth.

Yet another object of the present invention is to ensure safe operation of an illuminating device positioned within a user's mouth by insulating electrical connections to avoid causing an electric shock to the user.

Still another object of the present invention is to provide an illuminating device structured to avoid physically hurting a user's mouth during operation of the illuminating device.

Yet another object of the present invention is to provide an illuminating device that comfortably accommodates in a user's mouth, while at the same time enabling the user to converse with other people with the illuminating device in the user's mouth.

In view of the foregoing disadvantages inherent in the prior art, the general purpose of the present invention is to provide an illuminating device configured to include all advantages of the prior art, and to overcome the drawbacks inherent therein. The illuminating device includes a light source and a mouthpiece. The mouthpiece is configured to adapt the light source thereon. The mouthpiece is capable of being accommodated within a user's mouth. The mouthpiece includes a switch and a power source. The switch is electrically connected to the light source, and the power source is electrically connected to the switch and the light source. The power source is capable of providing electrical power to the light source for illumination. Upon receipt of the mouthpiece within the user's mouth and application of pressure on the switch by the user's teeth, the light source is illuminated.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

For a thorough understanding of the present invention, reference is to be made to the following detailed description, including the appended claims, in connection with the above-described drawings. Although the present invention is described in connection with exemplary embodiments, the present invention is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting. The terms "a" and "an" herein do not denote a limitation of quantity, but rather denote the presence of at least one of the referenced item.

The present invention provides an illuminating device. The illuminating device includes a light source and a mouthpiece. The mouthpiece is capable of being placed in a user's mouth and thereafter, being controlled by the user's mouth for illuminating the light source. The mouthpiece includes a switch and a power source. The switch is activated when a biting pressure is applied on the switch by the user's teeth. The switch and the power source are electrically connected to the light source. The switch activates the light source and the power source provides power to the light source for illumination. Thereby, the light source can be operated in a hands-free manner by the user.

Figure 1A:
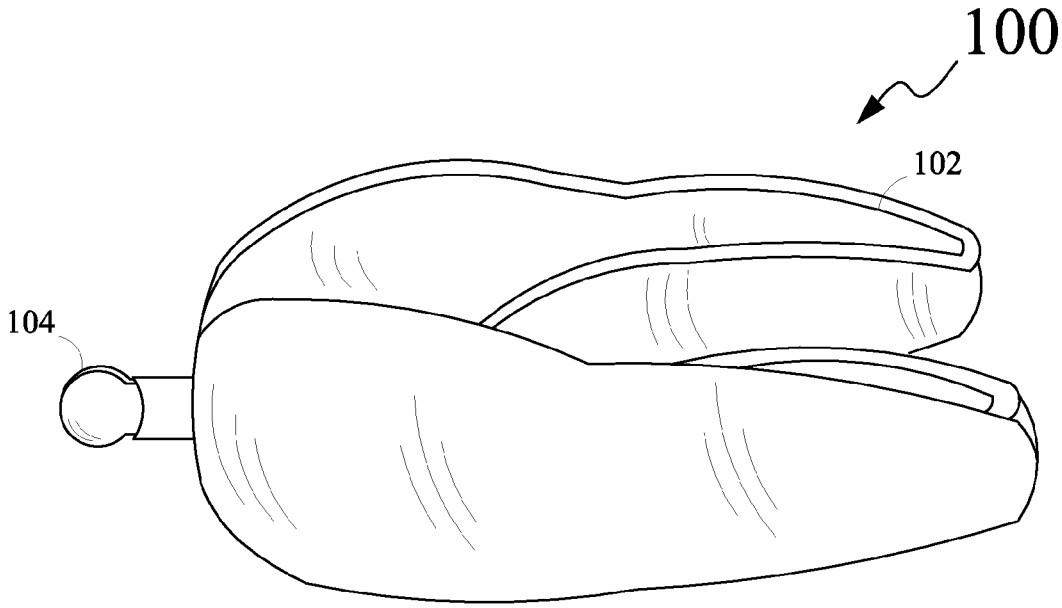
FIGS. 1A and 1B are a perspective view and a top view of an illuminating device, respectively, according to an exemplary embodiment of the present invention.
Figure 1B:
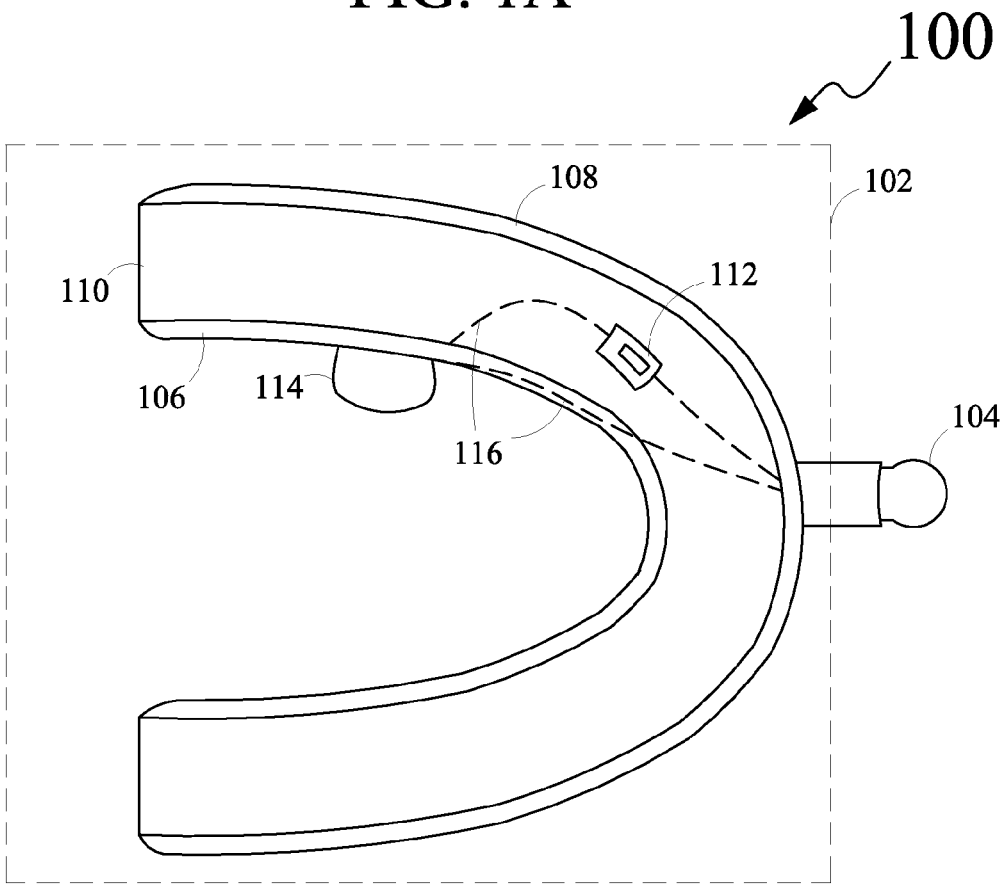
Figure 2A:
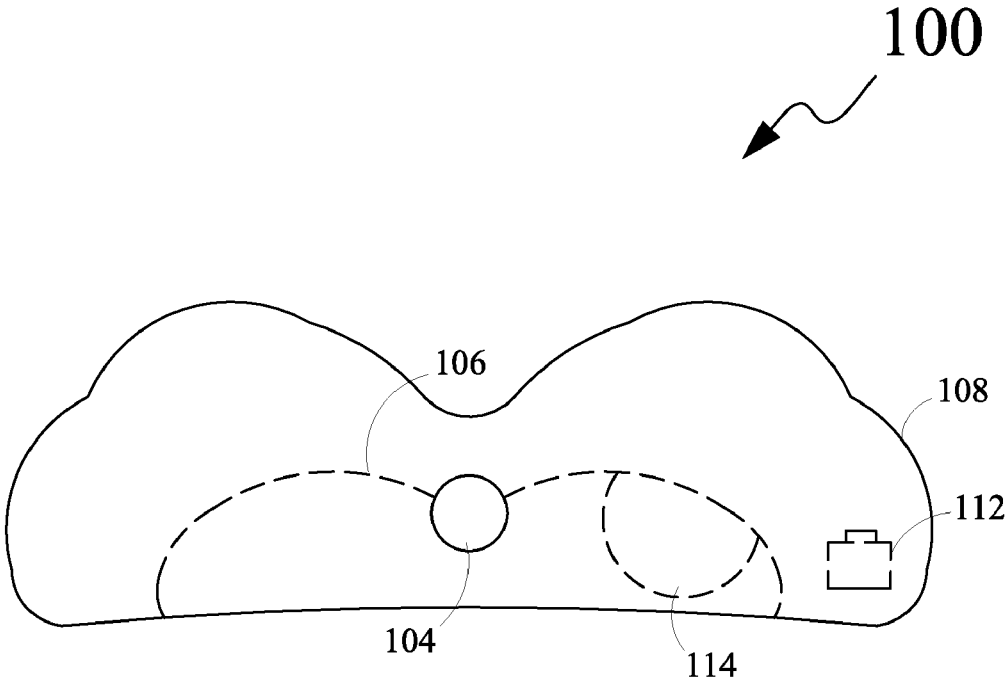
FIG. 2A is a front view of the illuminating device of FIG. 1.
Figure 2B:
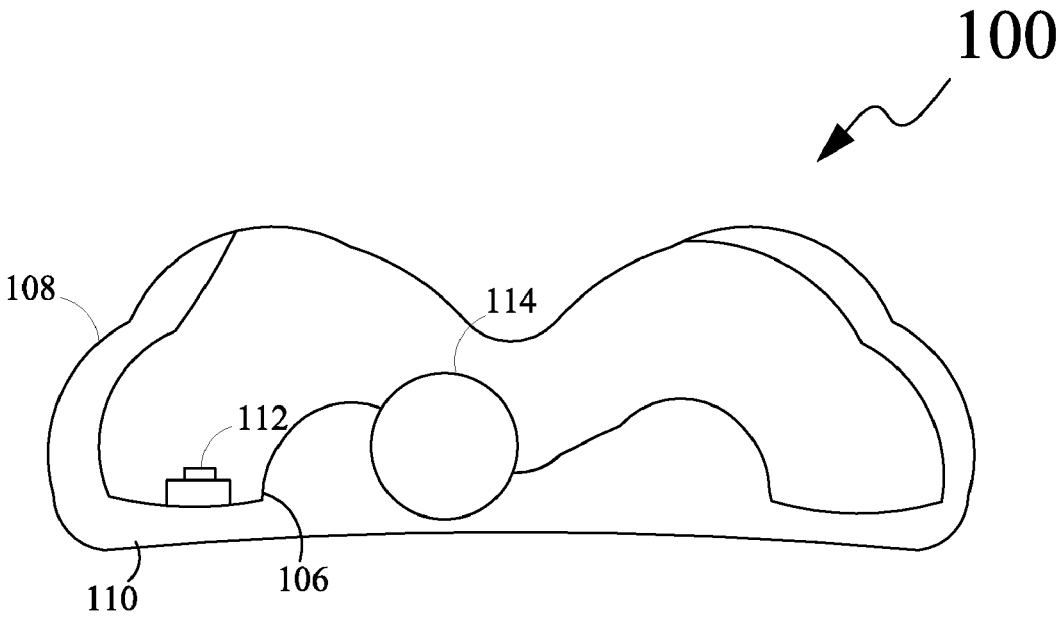
FIG. 2B is a back view of the illuminating device of FIG. 1.
Figure 2C:
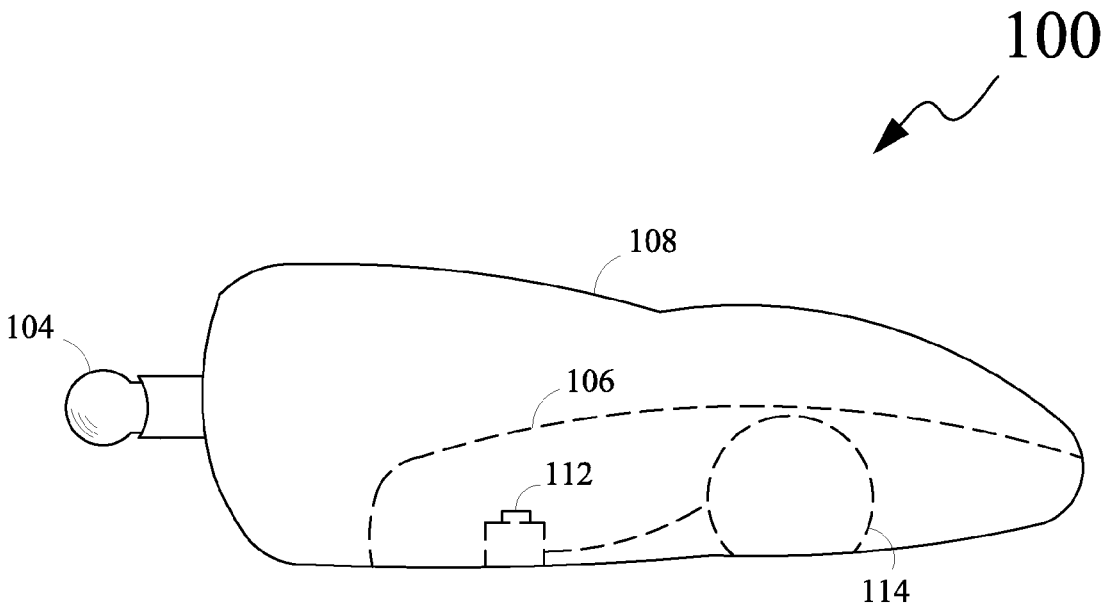
FIG. 2C is a first side view of the illuminating device of FIG. 1.
Figure 2D:
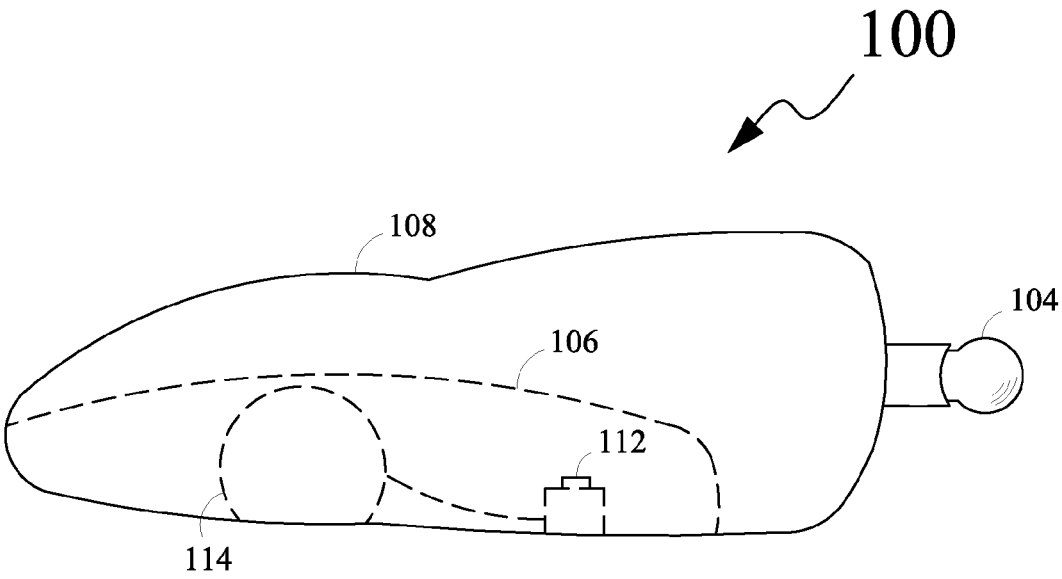
FIG. 2D is a second side view of the illuminating device of FIG. 1.

Referring to FIGS. 1A, 1B, and 2A-2D an illuminating device 100, is shown. FIGS. 1A and 1B represent a perspective view and a top view of the illuminating device 100, respectively, according to an exemplary embodiment of the present invention. FIG. 2A is a front view of the illuminating device 100 of FIG. 1. FIG. 2B is a back view of the illuminating device 100 of FIG. 1. FIG. 2C is a first side view of the illuminating device 100 of FIG. 1. FIG. 2D is a second side view of the illuminating device 100 of FIG. 1.

The illuminating device 100 includes a mouthpiece 102 and a light source 104. The mouthpiece 102 is capable of adapting the light source 104 thereon. The mouthpiece 102 is capable of being accommodated within a user's mouth such that the light source 104 extends outwards from the user's mouth when the mouthpiece 102 is grasped within the user's mouth, thereby providing illumination for the job to be performed by the user.

In one embodiment, the mouthpiece 102 is structured as a mouth-guard, as shown in FIG. 1A. The mouth-guard structure of the mouthpiece 102 enables grasping of the mouthpiece 102 in the user's mouth, within the user's teeth. The mouthpiece 102 surrounds the user's gums and teeth when mounted within the user's mouth. The mouthpiece 102 is accommodated under the user's upper jaw. The mouthpiece 102 includes control means for operating the light source 104. The control means are embedded in the mouthpiece 102 that acts as a housing for the control means. The user is able to operate the mouthpiece 102 without utilizing his hands, thereby controlling illumination of the light source 104 in a hands-free manner. The mouthpiece 102 is positioned within the user's mouth and by utilizing the control means the user may power on/off the light source 104.

As shown in the top view in FIG. 1B, the mouthpiece 102 may have a curve shaped configuration. The curve is configured to conform to shape of the user's teeth. The mouthpiece 102 includes an inner wall 106, an outer wall 108 and a base 110. The inner wall 106 and the outer wall 108 are curved edge walls that run parallel to each other, with the base 110 therebetween. The base 110 forms a curved channel between the inner wall 106 and the outer wall 108. The base 110, in conjunction with the inner wall 106 and the outer wall 108 may configured to conform to shape of teeth and gums of a particular user, or the configuration may follow the general shape of adult or child human teeth and gums.

Also, the outer wall 108 has a structural feature for adapting the light source 104 thereon. The positioning of the structural feature of the outer wall 108 is such that the light source 104 is positioned at a central portion of the curve shaped mouthpiece 102 and extends outwards from the user's mouth, when the mouthpiece 102 is accommodated within the user's teeth.

The base 110 is designed such that the user may be able to grasp the mouthpiece 102 by placing the user's teeth on the base 110.

The mouthpiece 102 may be made of any suitable resilient material providing sufficient resiliency to conform appropriately to user's teeth and user's gums, while providing no discomfort to the user when grasping the mouthpiece 102. The mouthpiece 102 may have different designs for structural and/or aesthetic purposes. Optionally, the mouthpiece 102 may further comprise a water resistant material. Additionally, the mouthpiece 102 may be flavored for providing a desirable taste to the user.

Further, the mouthpiece 102 includes the control means mentioned in conjunction with FIG. 1A above. In one embodiment, the control means include a switch 112 and a power source 114. The switch 112 is disposed on the base 110 of the mouthpiece 102. The switch 112 is electrically connected to the light source 104 and the power source 114 with wires 116. Further, the power source 114 is electrically connected to the light source 104 with the help of the wires 116, as shown in FIG. 1B. The power source 114 is disposed on a surface of the inner wall 106 that faces away from the outer wall 108 of the mouthpiece 102, as most clearly represented in FIGS. 2A and 2B. In an embodiment, the power source 114 may be within a sealed container. The power source 114 is capable of providing electrical power to the light source 104 for illumination. The light source 104 is illuminated when the user applies a biting pressure on the switch 112 with the user's teeth. The switch 112 activates with the biting pressure to close an electrical circuit which then turns on the light source 104. In one embodiment of the present invention, the switch 112 is activated by pressure.

Suitable examples of the light source 104 include, but are not limited to, Light Emitting Diodes (LEDs) and laser diodes. In one embodiment, the light source 104 is a Light Emitting Diode (LED). An LED requires about 3 volts electrical power from the power source 114 to be powered on. The power source 114 includes but is not limited to, stored power, such as power from a battery. For example, the power source 114 is in the form of a battery compartment housing a pack of rechargeable batteries. The switch 112 and the power source 114 are embedded in the mouthpiece 102 in a concealed manner to avoid causing electric shock to the user due to the wet environment of the user's mouth. Additionally, the switch 112 may be inlaid within rubber so as to provide comfort to the user while biting the switch 112 when the user desires to illuminate the light source 104. Moreover, the rubber covering will ensure insulation to the switch 112 in the wet environment of the user's mouth avoiding conduction of current in the user's mouth.

Further, the wires 116 that connect the power source 114, the switch 112 and the light source 104 to each other also need to be covered with an insulating material and concealed within the mouthpiece 102 to avoid electrical conduction in the user's mouth. The light source 104 extends outwards from the user's mouth when the mouthpiece 102 is grasped within the user's mouth, thereby providing illumination for the job to be performed by the user.

An illuminating device, such as the illuminating device 100 of the present invention, is advantageous for providing a light source without requiring a user to use his hands for operating the illuminating device. More importantly, the illuminating device is beneficial to the user in performing jobs such as blacksmithing, carpentry, mechanics, and other physically intensive jobs that require use of both hands of the user, especially when ambient illumination of a job site is insufficient or absent. The illuminating device allows the user to illuminate the light source in a hands-free manner, by utilizing the user's mouth. Further, the illuminating device is designed to provide comfort and safety to the user when placed in the user's mouth without causing any injuries or discomfort to the user. Moreover, elements of the illuminating device that carry electrical current are concealed by an insulating material, thereby rendering the illuminating device safe despite wet environment of the user's mouth. The illuminating device may be used by various people, such as blacksmiths, carpenters, mechanics, contractors, plumbers, hikers (to read maps), and similarly-situated persons when ambient illumination is insufficient or absent.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, to thereby enable others skilled in the art to best utilize the present invention and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present invention.

What is claimed is:

1. An illuminating device, comprising:

a light source; and a mouthpiece coupled to the light source, the mouthpiece selectively interposed within a user's mouth with the light source extending therefrom, wherein the mouthpiece surrounds the user's upper gums and teeth while permitting the user to converse with other people, the mouthpiece comprising a switch electrically connected to the light source and operated by the user's teeth, and a power source electrically connected to the switch and the light source, wherein the power source is capable of providing electrical power to the light source for illumination, and wherein the power source is selectively interposed within the user's mouth;

wherein upon receipt of the mouthpiece within the user's mouth and application of pressure on the switch by the user's teeth, the light source is illuminated for a job to be performed by the user.

2. The illuminating device of claim 1, wherein the light source extends outwards from the user's mouth when the mouthpiece is accommodated within the user's mouth.

3. The illuminating device of claim 1, wherein the mouthpiece is made of a resilient material.

4. The illuminating device of claim 1, wherein the mouthpiece is made of a water-resistant material.

5. The illuminating device of claim 1, wherein the mouthpiece is flavored.

6. The illuminating device of claim 1, wherein the switch is inlaid with rubber.

7. The illuminating device of claim 1, wherein the light source is a Light Emitting Diode (LED).

8. The illuminating device of claim 1, wherein the power source and the switch are concealed within the mouthpiece.

* * * * *